US012060245B2

(12) United States Patent
Fernandez et al.

(10) Patent No.: US 12,060,245 B2
(45) **Date of Patent: *Aug. 13, 2024**

(54) METHODS AND DEVICES FOR TRANSPORTING YARN

(71) Applicant: COLUMBIA INSURANCE COMPANY, Omaha, NE (US)

(72) Inventors: Conrad L. Fernandez, Dalton, GA (US); Chad Christopher Anderson, Rocky Face, GA (US); Fidel Gonzalez, Dalton, GA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/154,054

(22) Filed: Jan. 13, 2023

(65) Prior Publication Data

US 2023/0143253 A1 May 11, 2023

Related U.S. Application Data

(63) Continuation of application No. 17/396,126, filed on Aug. 6, 2021, now Pat. No. 11,565,907.

(60) Provisional application No. 63/062,023, filed on Aug. 6, 2020.

(51) Int. Cl.

| | |
|---|---|
| ***B65H 57/16*** | (2006.01) |
| ***B65H 54/76*** | (2006.01) |
| ***B65H 57/12*** | (2006.01) |
| ***D05C 15/16*** | (2006.01) |

(52) U.S. Cl.

CPC ..... *B65H 57/16* (2013.01); *B65H 54/76* (2013.01); *B65H 57/12* (2013.01); *D05C 15/16* (2013.01); *B65H 2701/31* (2013.01)

(58) Field of Classification Search

CPC ..... B65H 54/76; B65H 54/84; B65H 57/12; B65H 57/16; B65H 2701/31; D05C 15/16; D04B 35/22; D03J 1/00

See application file for complete search history.

(56) References Cited

U.S. PATENT DOCUMENTS

| | | | | |
|---|---|---|---|---|
| 2,304,501 | A | 8/1942 | Hommer | |
| 4,420,108 | A | 12/1983 | Kallmann | |
| 6,634,585 | B1 | 10/2003 | Ingram | |
| 10,023,330 | B2 | 7/2018 | Schumann | |
| 11,565,907 | B2 * | 1/2023 | Fernandez | B65H 57/12 |

(Continued)

FOREIGN PATENT DOCUMENTS

EP 0 058 478 B1 * 9/1986

OTHER PUBLICATIONS

PCT Search Report for PCT Application No. PCT/US21/44975, mailed Jan. 28, 2022.

*Primary Examiner* — William E Dondero
(74) *Attorney, Agent, or Firm* — Ballard Spahr LLP

(57) ABSTRACT

A system can comprise a plurality of containers that are coupled together as a movable unit. A plurality of container-feeding assemblies can be configured to simultaneously deliver respective yarns into respective containers of the plurality of containers. A header can be selectively attachable to a tufting machine, the header having a longitudinal axis. A retainer can be configured to extend across the header along the longitudinal axis to secure the respective yarns in respective positions relative to each other along the longitudinal axis.

19 Claims, 17 Drawing Sheets

(56) References Cited

U.S. PATENT DOCUMENTS

| | | | |
|---|---|---|---|
| 2018/0319618 | A1 | 8/2018 | Wiele |
| 2023/0002185 | A1 | 1/2023 | Shamis et al. |

* cited by examiner

METHODS AND DEVICES FOR TRANSPORTING YARN

CROSS-REFERENCE TO RELATED APPLICATIONS

This application is a continuation of U.S. patent application Ser. No. 17/396,126, filed Aug. 6, 2021, which claims priority to and the benefit of the filing date of U.S. Provisional Patent Application No. 63/062,023, filed Aug. 6, 2020, the entirety of each of which is hereby incorporated by reference herein.

FIELD

This application is directed to devices, systems, and methods for transporting yarn.

BACKGROUND

Yarn is conventionally transported on yarn packages, or yarn cones, that are stacked (e.g., in three layers of twelve yarn packages per layer) and transported from a heatset tunnel to a creel for further processing. A yarn package can often weigh between ten and twenty pounds. Thus, a substantial amount of labor is required to handle and transport the yarn packages from the heatset tunnel to the creel. Additionally, creels take up large amounts of space (having a cost associated therewith), and can be an ergonomic concern, requiring operators to work over their heads to load heavy yarn packages. Accordingly, an alternative to using a creel is desirable.

SUMMARY

Disclosed herein, in one aspect, is a system that can comprise a plurality of containers that are coupled together as a movable unit and a plurality of container-feeding assemblies that are configured to simultaneously deliver respective yarns into respective containers of the plurality of containers.

In another aspect, a method can comprise delivering a first plurality of yarns into respective containers. The header can be a first header. The retainer can be secured to the first header to fix the respective yarns of the first plurality of yarns in respective positions relative to each other along the longitudinal axis of the first header. The first plurality of yarns can be severed so that each yarn of the first plurality of yarns has a first end within a respective container and an opposing loose end, wherein the clamp is secured to the first header between the first ends and the loose ends of the first plurality of yarns. The movable unit can be positioned proximate to a second header of a tufting machine. The tufting machine can have a second plurality of yarns thereon. Each yarn of the second plurality of yarns on the tufting machine can have a respective beginning end. The first header can be aligned with the second header so that the loose ends of the first plurality of yarns are aligned with respective beginning ends of the second plurality of yarns on the tufting machine. Respective loose ends of the first plurality of yarns in the containers can be coupled to respective beginning ends of the second plurality of yarns of the tufting machine.

In another aspect, a system can comprise a warp beam machine that is configured to wind a plurality of yarns received from one or more heatset apparatus around a warp beam. A header can be configured to receive yarn ends of the yarns in the plurality of containers. The header can have a longitudinal axis. A retainer can be configured to extend across the header along the longitudinal axis to secure the respective yarns in respective positions relative to each other along the longitudinal axis.

In another aspect, a method can comprise winding a first plurality of yarns onto the warp beam. The header can be a first header. The clamp can be secured to the first header to fix the respective yarns of the first plurality of yarns in respective positions relative to each other along the longitudinal axis of the header. The first plurality of yarns can be severed so that each yarn of the first plurality of yarns has a loose end proximate the first header, wherein the first header and clamp are fixed together between the warp beam and the loose ends of the first plurality of yarns. The warp beam can be positioned proximate to a second header of a tufting machine. The tufting machine can have a second plurality of yarns thereon. Each yarn of the second plurality of yarns on the tufting machine can have a respective beginning end. The first header can be aligned with the second header so that the loose ends of the first plurality of yarns are aligned with respective beginning ends of the second plurality of yarns on the tufting machine. Respective loose ends of yarns of the first plurality of yarns on the warp beam can be coupled to respective beginning ends of the second plurality of yarns of the tufting machine.

In another aspect, a method can comprise delivering a first plurality of yarns into respective containers. The first plurality of yarns can be severed so that each yarn of the first plurality of yarns has a loose end. The movable unit can be transported to a twisting machine, the twisting machine comprising at least one twister. Pairs of loose ends of yarns of the first plurality of yarns can be fed into respective twisters of the twisting machine.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

The present invention can be understood more readily by reference to the following detailed description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an," and "the" include plural referents unless the context clearly dictates otherwise. Thus, for example, reference to "a tube" can include two or more such tubes unless the context indicates otherwise.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 1:
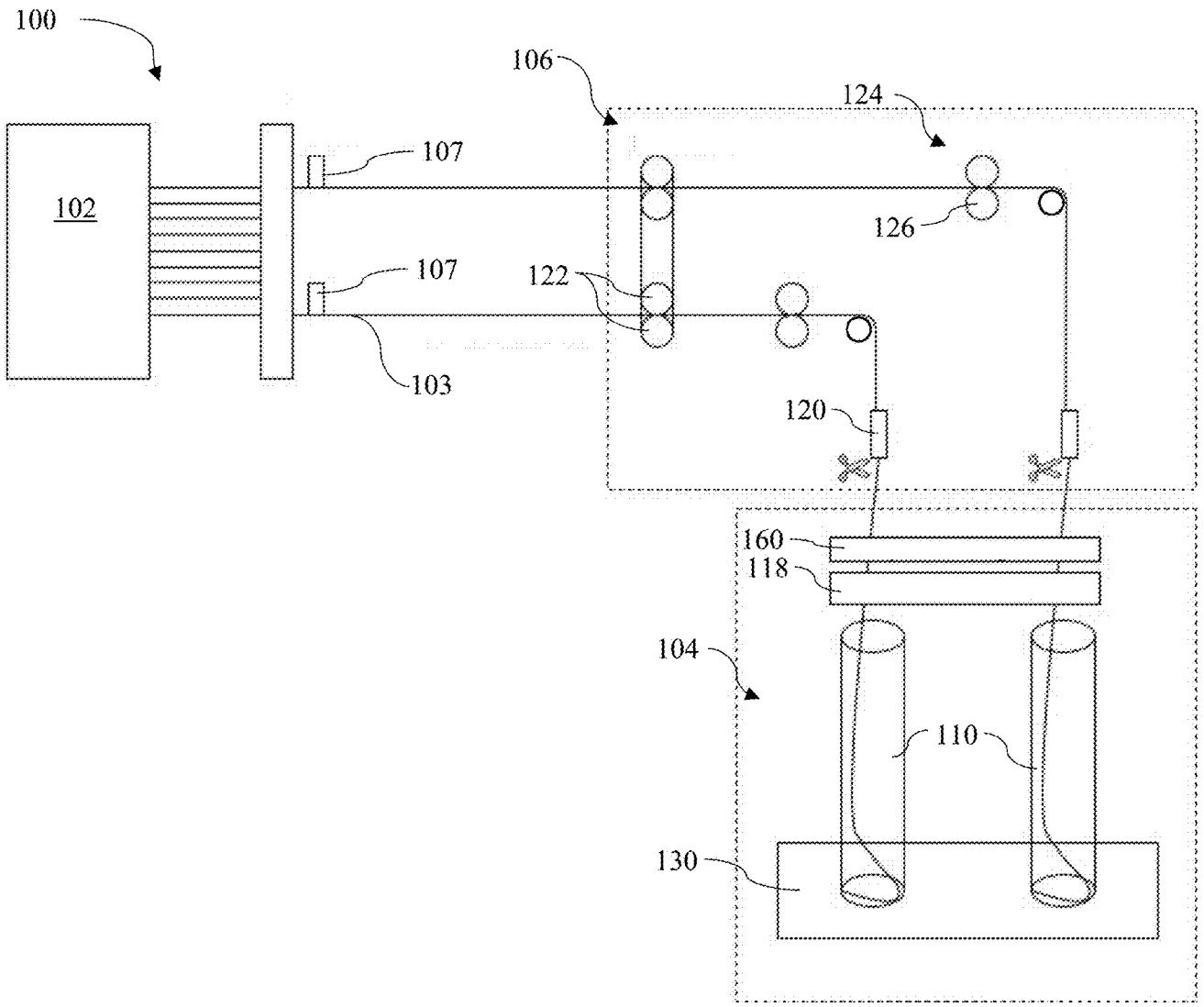
FIG. 1 is a schematic diagram of a system for providing yarn into a yarn transport module.

Referring to FIG. 1, a system 100 can comprise a heatset 102 or other yarn production machine that is configured to produce a plurality of yarns 103 (e.g., 24-48 yarns). The heatset 102 can provide yarn to one or more yarn transport modules 104 via a delivery system 106. Optionally, the delivery system 106 can simultaneously deliver each yarn of the plurality of yarns from a tunnel of the heatset 102 into the yarn transport module(s) 104. A respective yarn break and tension sensor 107 can both monitor yarn tension and detect yarn break for each yarn. Such yarn break and tension sensors 107, such as those provided by BTSR, can detect yarn break via optical or tension methods and are known and commonly used in the industry.

Yarn Transport Module Comprising Multiple Containers

Figure 2:
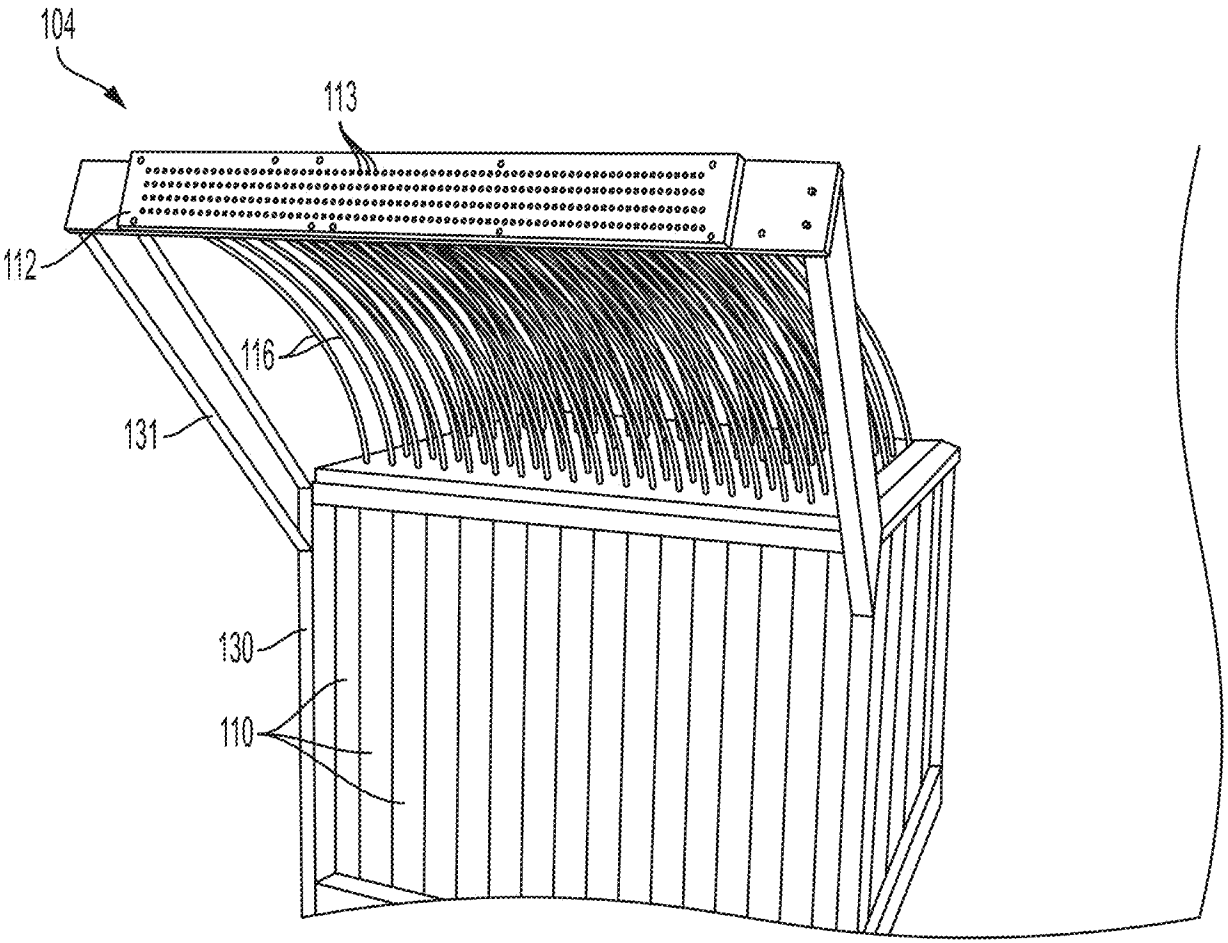
FIG. 2 is a perspective view of a yarn transport module in accordance with embodiments disclosed herein.
Figure 3:
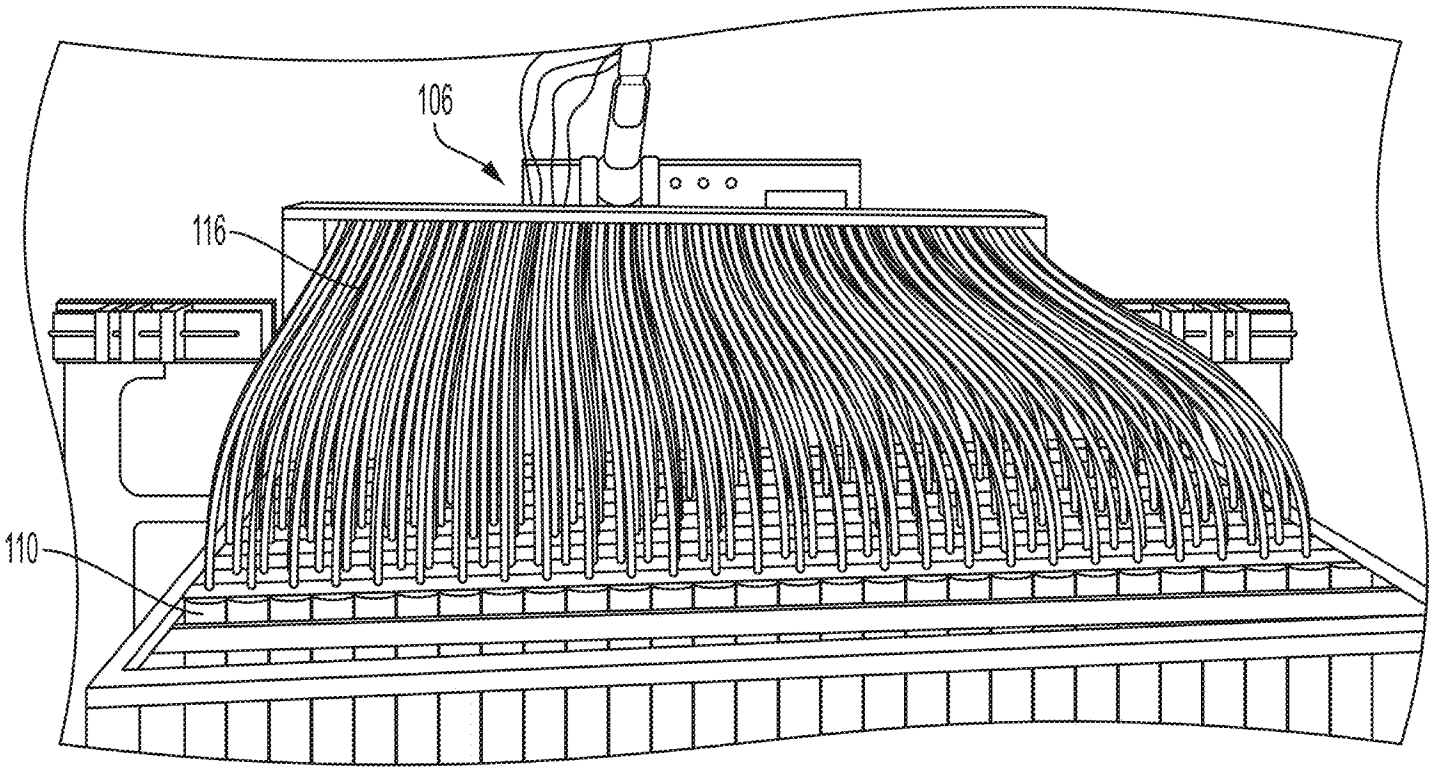
FIG. 3 is a rear end view of a yarn transport module in communication with a plurality of aspirators for providing yarn into containers of the transport module.
Figure 11:
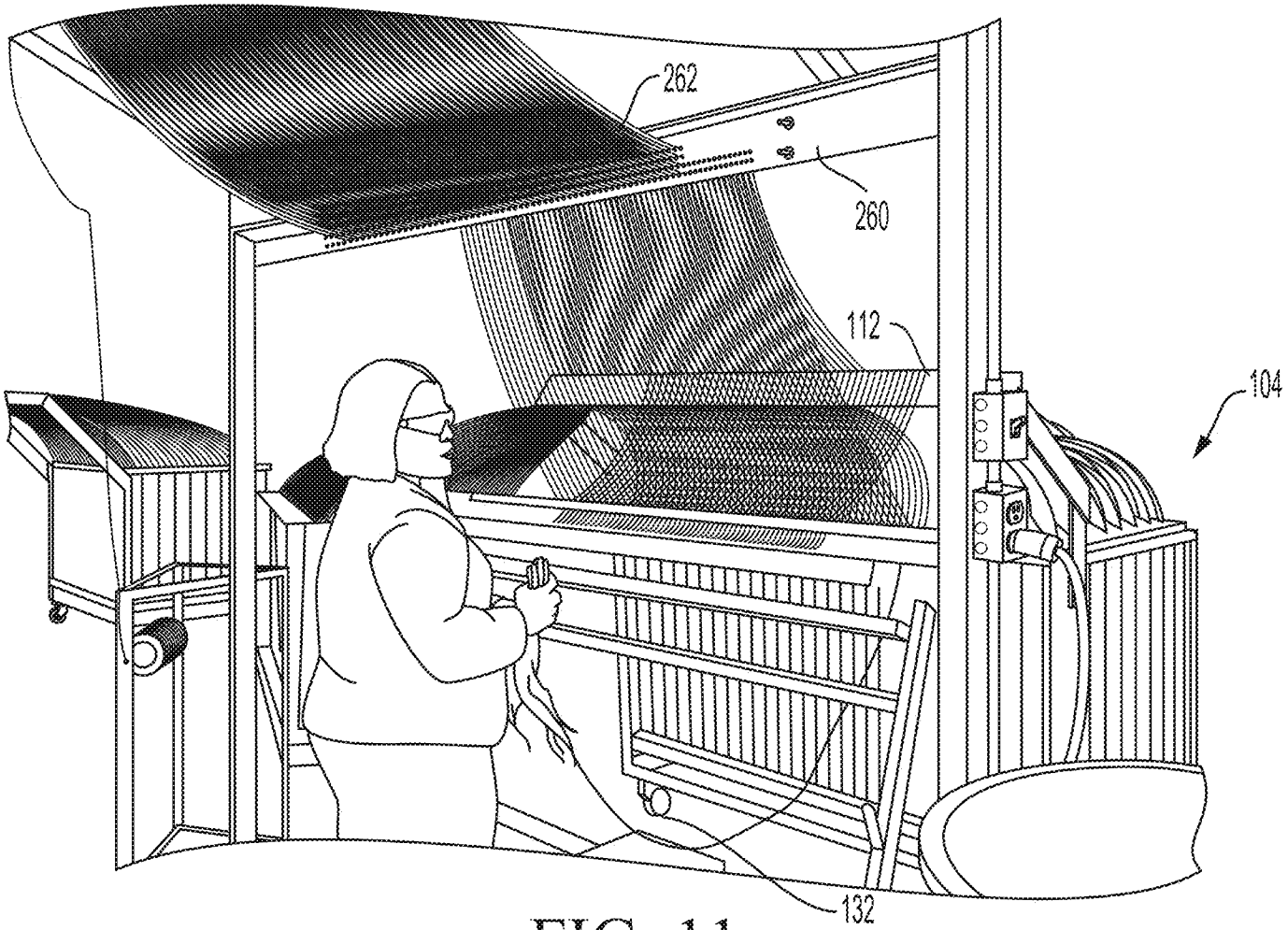
FIG. 11 is a perspective view of a yarn transport module comprising a plurality of yarn containers delivering yarn to a tufting machine at a splicing station.

Referring also to FIGS. 2-3, each yarn transport module 104 can comprise a plurality of containers 110 that are coupled together as a movable unit. The yarn transport module 104 can comprise a frame 130 to which the plurality of containers 110 are mounted or otherwise secured (such that the containers are coupled together through the frame). Optionally, the yarn transport module 104 can comprise the same number of containers as the number of yarn ends that the heatset tunnel simultaneously provides (e.g., 24 or 48). In further optional aspects, the yarn transport module 104 can comprise a multiple of the number of yarn ends that the heat set tunnel simultaneously provides (e.g., 72 or 96 containers). The frame 130 can be supported on a plurality of wheels 132 (FIG. 11). The yarn transport modules 104 can comprise an adapter plate 112 that is configured to interface with the yarn delivery system 106.

A plurality of guide tubes 116 can extend between the adapter plate 112 and respective containers 110 to guide respective yarns between the adapter plate 112 and the containers. As further described herein, it is contemplated that the adapter plate 112 can define a plurality of openings 113 (e.g., holes) that are aligned with corresponding guide tubes 116. The openings can be spaced and otherwise configured to interface with the yarn delivery system 106 (e.g., a plurality of aspirators), as further disclosed herein.

Figure 10:
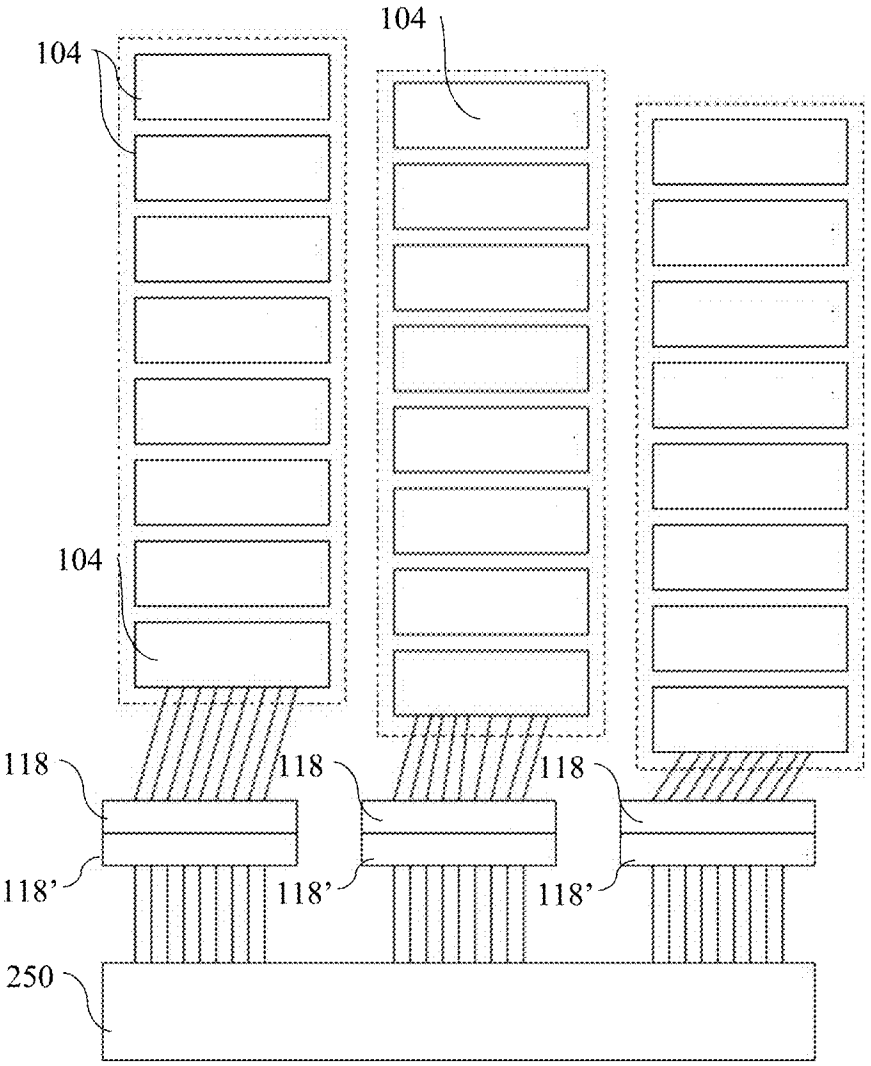
FIG. 10 is a schematic of a tufting system comprising a tufting machine and a plurality of yarn transport modules.

The yarn transport modules 104 can further comprise a removable header 118 that can maintain the yarn ends in a spaced relationship to inhibit the yarns from crossing, getting tangled, etc. The removable header 118 can rest on, or attach to, the frame 130 of the yarn transport module 104. For example, the removable header 118 can optionally be received within hooks, grooves, a receptacle, or other carrying structure (not shown) defined by the frame 130. In some optional aspects, the removable header 118 can be configured to couple to a corresponding removable header 118' of a tufting machine (or a twisting machine, as further disclosed herein). In this way, as further described herein, the removable headers 118, 118' can enable rapid alignment and coupling between yarn ends to facilitate splicing of the yarn ends of the yarn transport modules 104 with the yarn ends of the tufting machine. In various aspects and as illustrated in FIG. 10, each transport module can comprise a respective removable header 118, and the tufting machine (or twisting machine) can comprise one or a plurality of removable headers 118' that are configured to interface with the removable headers 118 of respective transport modules. Accordingly, a system can comprise a plurality of removable headers 118, 118'.

Figure 4:
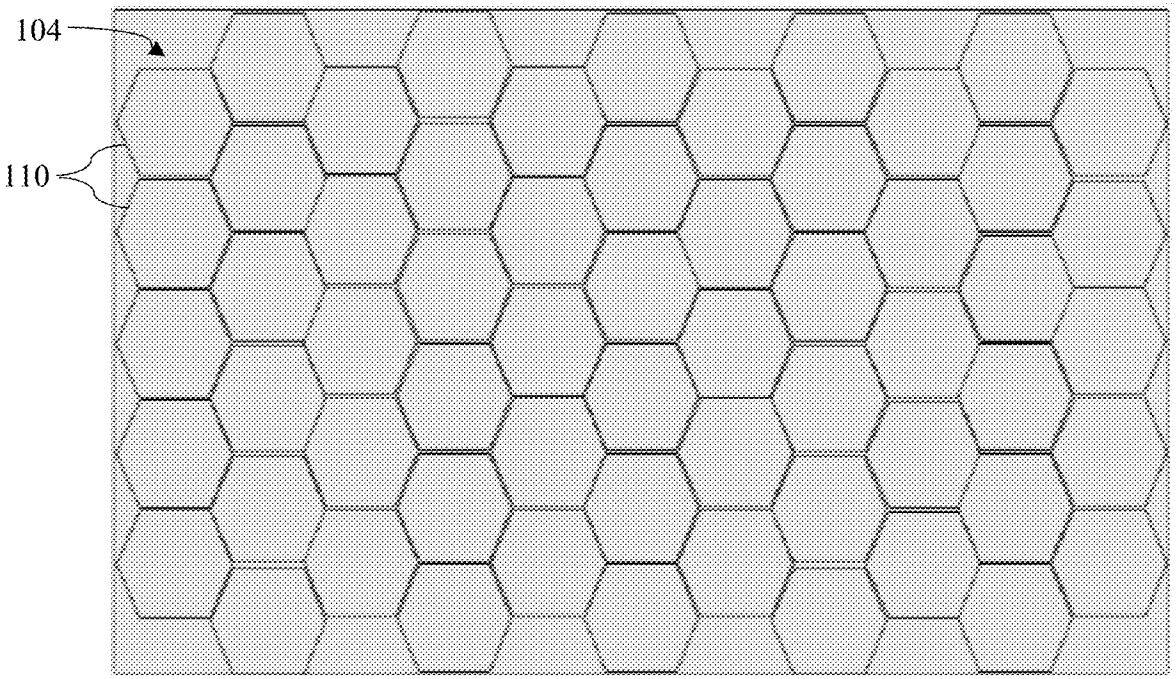
FIG. 4 is a cross-sectional view of a plurality of containers of a yarn transport module.

In some optional aspects, the containers 110 can be tubular or substantially tubular. For example, optionally, the containers 110 can be hollow elongate bodies having rigid walls. Optionally, some or all of the containers 110 can have a consistent cross section along their lengths. In various aspects, the containers 110 can have circular cross sections, hexagonal cross sections, or any other suitable cross section. For example, referring to FIG. 4, hexagonal containers 110 can be arranged in a honeycomb configuration. Optionally, the hexagonal containers can have a side length (a length of each side of the hexagonal profile) of five inches and a longitudinal length of 36 inches. In some aspects, the containers 110 (or a portion thereof) can be see-through (optionally, transparent or translucent) to allow an operator to see through at least a portion of the containers to determine the remaining capacity in the containers. In various aspects, the containers 110 can comprise paper (e.g., cardboard) or polymer (e.g., Plexiglas) materials. In still further aspects, the containers 110 can comprise burlap or cloth materials. Optionally, each yarn transport module 104 can cooperatively be configured to hold a quantity of yarn sufficient to manufacture 500-2000 yards of finished carpet.

Figure 8:
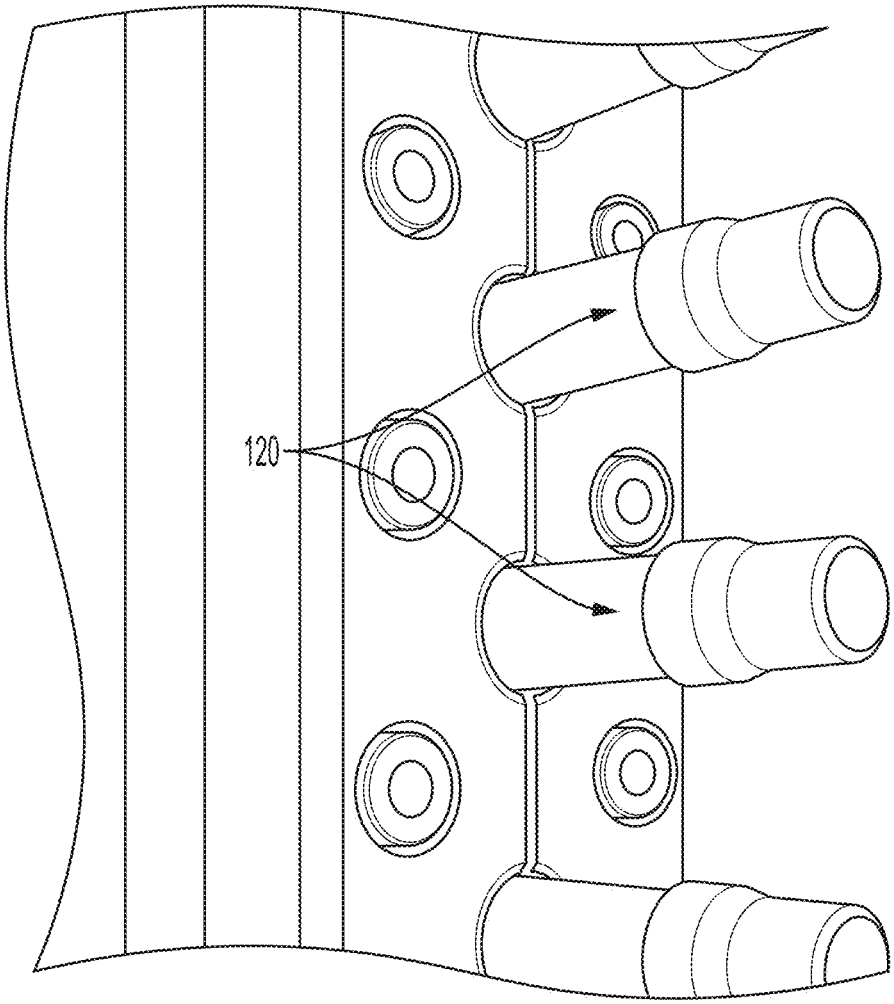
FIG. 8 is a partial perspective view of a plurality of yarn aspirators of a yarn feeding assembly for providing yarn into respective yarn containers of a yarn transport module.

Referring to FIG. 8, the delivery system 106 can comprise a plurality of aspirators 120. In some aspects, the delivery system 106 can have a respective aspirator 120 for each yarn from the heat set 102 or other yarn production machine (e.g., 24 or 48 aspirators). The aspirators 120 can be positioned at the adapter plate 112 so that the aspirators are in engagement with the ends of the guide tubes opposite the containers 110. The holes 113 in the adapter plate 112 can be spaced and otherwise arranged to simultaneously receive respective aspirators of the plurality of aspirators 120. In some aspects, each aspirator 120 can have a diameter that is slightly smaller than the diameter of the openings 113 in the adapter plate 112 to provide a clearance between the aspirator and the respective opening, thereby preventing wear and tear from sliding engagement. Each opening 113 can provide communication to a respective guide tube 116. The aspirators 120 can be configured to deliver yarn through the guide tubes 116 into the containers 110. In some aspects, the delivery system 106 can comprise a respective aspirator 120 for each container 110 of the yarn transport module 104. Accordingly, in some aspects, the delivery system 106 can comprise, for example, 24 or 48 aspirators. In this way, the delivery system 106 can simultaneously fill all of the containers 110 of the yarn transport module 104.

Figure 7:
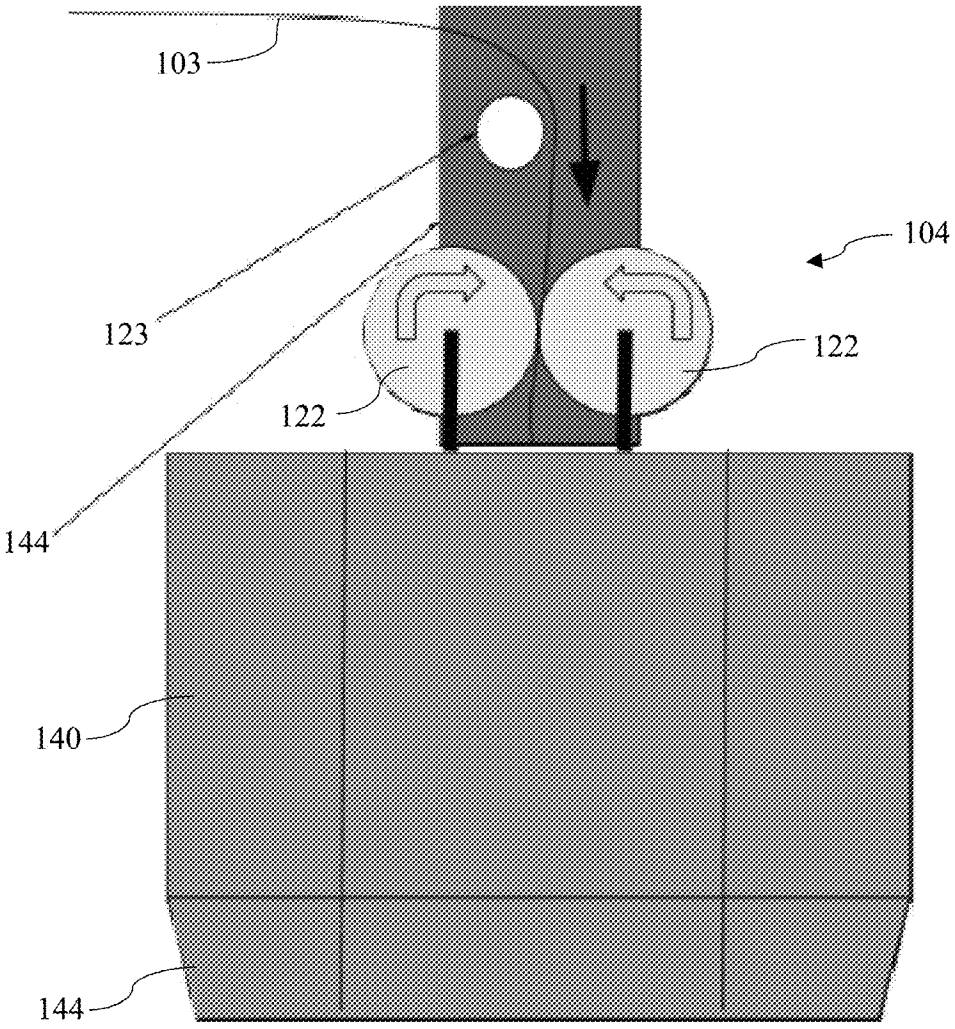
FIG. 7 is a schematic side view of a yarn feeding assembly for providing yarn through a plunger as in FIG. 5 and into a yarn container.

Referring to FIGS. 1 and 7, the delivery system 106 can further comprise opposing drive rollers 122 that bias against opposing sides of the yarn. At least one of the opposing drive rollers can be coupled to a motor that is configured to cause rotation of the roller to thereby drive movement of the yarn. Optionally, a sheave 123 can direct the path of yarn to the opposing rollers 122. Optionally, the delivery system 106 can comprise a plurality of sets of opposing drive rollers 122.

As shown in FIG. 1, the delivery system 106 can further comprise a metering device 124. The metering device can optionally comprise a pair of rollers 126 that rotate as yarn is drawn therethrough. The number of rotations of a roller multiplied by the circumference of the roller can correspond to the length of yarn drawn through the metering device 124. As shown in FIG. 1, it is contemplated that the metering device 124 can be positioned between the drive rollers 122 and the aspirators 120 (along the path of yarn movement away from the heat set). Optionally, it is contemplated that a plurality of metering devices 124 can be provided (e.g., one or multiple metering devices per yarn).

Figure 5:
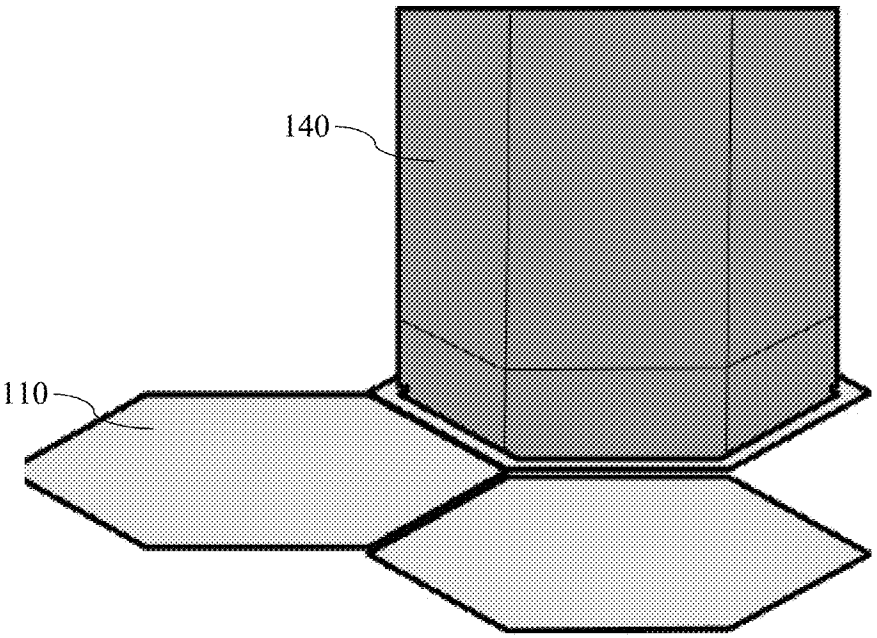
FIG. 5 is a schematic partial perspective view of a plurality of containers and a plunger for compacting yarn in a container.
Figure 6:
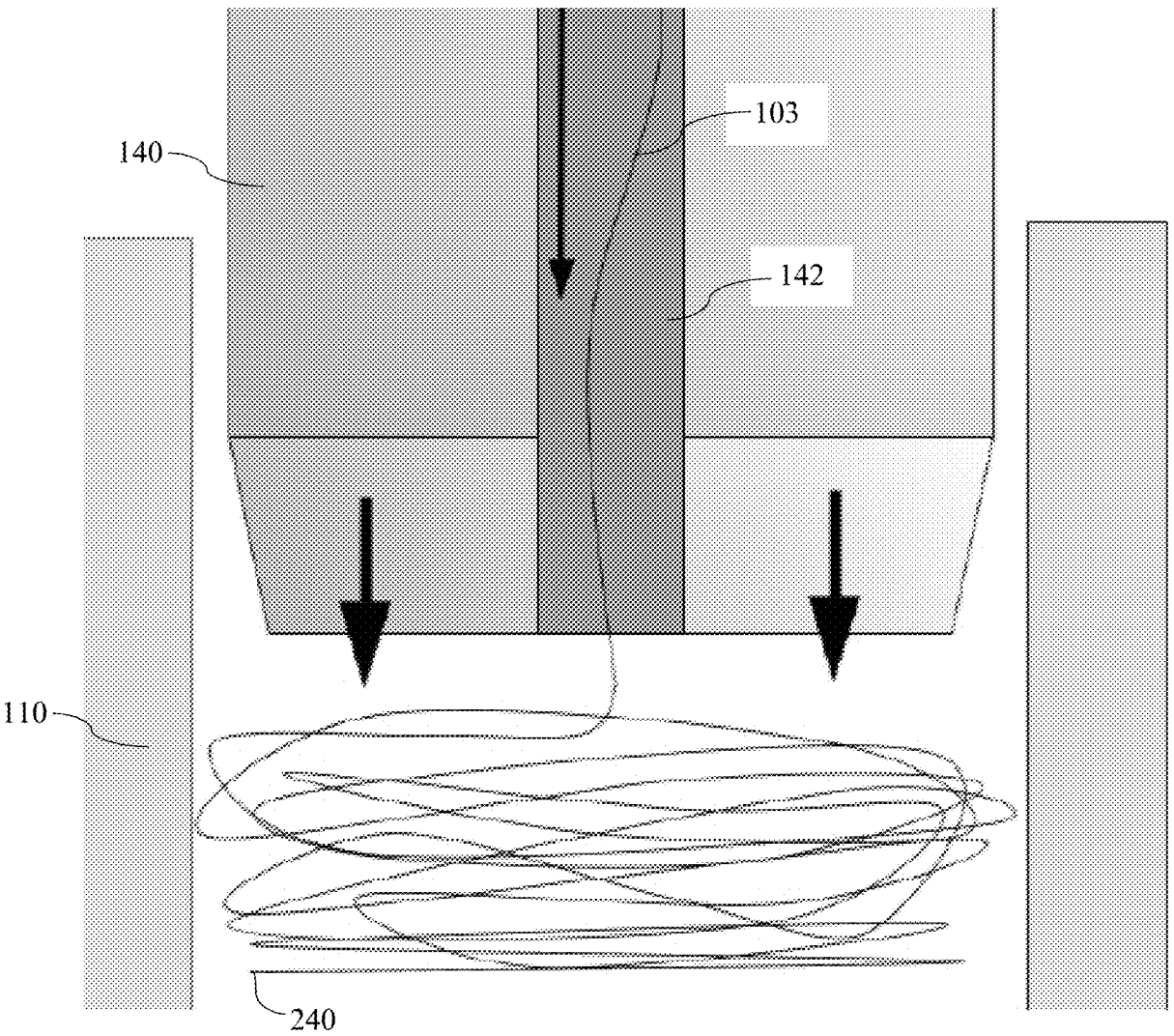
FIG. 6 is a schematic cross-sectional view of the plunger and yarn container with yarn therein.

As shown in FIGS. 5-6, it is contemplated that a plurality of plungers 140 can be configured to compress the yarn 103 within the containers 110 (e.g., tubes). For example, a respective plunger 140 can be configured to reciprocally move inwardly into each container 110 to compress the yarn 103 within the container. The plunger 140 can optionally define a cross section that is the same shape or substantially the same shape as the cross section of the container 110 in the same plane that is perpendicular to the longitudinal axis of the container (e.g., a hexagonal plunger for a hexagonal container or a round plunger for a cylindrical tube container). The dimensions of the plunger 140 can be selected to allow sufficient clearance for receipt of the plunger into the container 110. The plunger 140 can define a bore 142 therethrough, and a yarn 103 can extend through the bore of each plunger. In some aspects, the plungers 140 can be configured to intermittently move inwardly into and outwardly from the container 110. In other aspects, the plungers 140 can continuously move inwardly into and outwardly from the container 110.

As shown in FIG. 7, it is contemplated that each of the plungers 140 can couple at proximal end to a respective shaft 144 that can be actuated by, for example, a pneumatic piston (not shown). The plunger 140 can optionally comprise a tapered distal end 144 that can facilitate insertion and alignment of the plunger with the respective container 110.

In some aspects, the plunger 140 can move relatively rapidly (e.g., approximately 5 inches per second for insertion and yarn compression and approximately 15 inches per second for retraction), and the yarn can continuously be delivered as the plunger is delivered into the container. In further aspects, the plunger 140 can move relatively more slowly (e.g., optionally, approximately three inches per second), and the yarn delivery can temporarily be halted as the yarn is compressed.

In some aspects, the plunger 140 can be controlled by a controller. The controller can be in communication with a load cell or a pressure sensor (e.g., a capacitive sensor; not shown) that can be configured to determine the axial of the plunger that provide sufficient, but not excessive, compression. In further aspects, the axial displacement of the plunger can be determined and controlled based on a quantity of yarn delivered to the container (using the metering device 124) and the capacity of the container.

In some optional aspects, each yarn can be fed through a respective plunger 140 via a pair of opposing rollers 122 that bias against opposing sides of the yarn. In some aspects, the opposing rollers 122 can be coupled to each piston 140. At least one of the opposing rollers 122 can be coupled to a motor to cause rotation of the roller. In these aspects, it is contemplated that the opposing rollers 122 associated with the piston can serve as the yarn delivery system 106, and the aspirators 120 can optionally be omitted. Optionally, these opposing rollers 122 can further serve as the metering device 124. In further aspects, a separate metering device 124 can be used to measure yarn delivered to the container. In further optional aspects, a venturi or compressed air can be used to drive the yarn through the plunger 140.

In further optional aspects, the containers 110 can have flexible sidewalls that can enable the containers to deform (e.g., expand) as they are filled with yarn.

In some optional aspects, the yarn transport modules 104 can be configured to be vertically stackable. For example, bottom features of a first yarn transport module 104 can cooperate with top features of a second yarn transport module 104 to retain and support the first yarn transport module on top of the second yarn transport module. Similar structural features can be provided on additional transport modules to permit stacking of three or more yarn transport modules. In some optional aspects, the adapter plate 112 can be coupled to the frame 130 in a lower profile than shown to facilitate stacking of yarn transport modules. Optionally, the adapter plate 112 can be movably coupled to the frame 130 so that the adapter plate 112 can be configured to be movable from a raised position (as shown in FIG. 2) to a lowered position (not shown). For example, in further embodiments, the adapter plate can couple to the frame via arms 131 that are pivotably coupled to the frame 130.

Removable Header

The yarns 103 can be held in a spaced arrangement via a removable header 118. The removable header 118 can be selectively positioned between the yarn containers 110 and a tufting machine 250 or other textile manufacturing device. Referring to FIGS. 13-16, in some aspects, the removable header 118 can comprise an elongate strip 150 defining a plurality of notches 152. The elongate strip 150 can have a longitudinal axis 151 and a transverse axis 153 that is perpendicular to the longitudinal axis. The notches 152 can guide the yarns into respective holes 156 (e.g., optionally, circular holes). The notches 152 can be tapered inwardly (relative to the transverse axis 153) from a first (notch opening) side 154 to the respective holes 156. In some aspects, the holes 156 can be positioned at a midpoint relative to the transverse axis 153.

Figure 15:
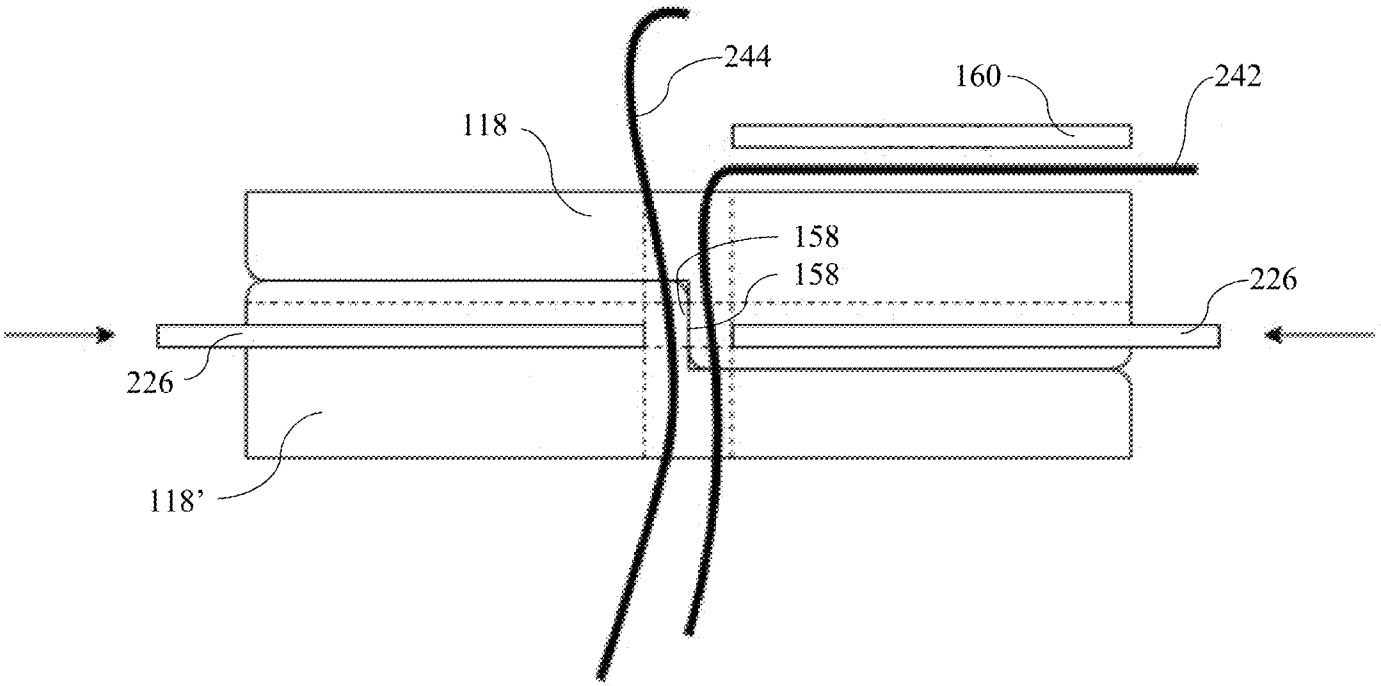
FIG. 15 is a cross-sectional schematic view of a pair of headers that are adjoined for coupling yarn ends together.
Figure 16:
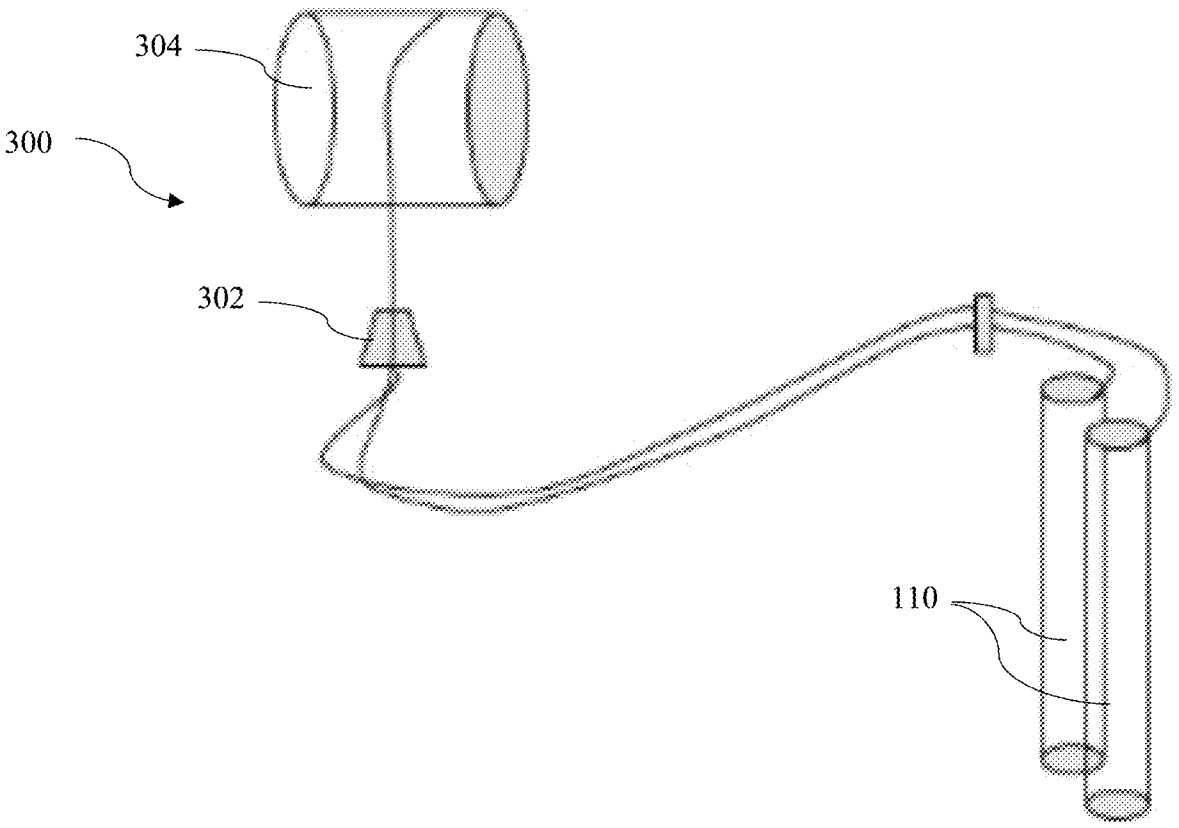
FIG. 16 is a schematic diagram of a system for providing yarn to a twisting machine.

It is contemplated that the header 118 can be shaped so that two of such removable headers 118, with one rotated (e.g., rotated 180 degrees) about the longitudinal axis with respect to the other header as shown in FIG. 15, can have two degrees of rotational symmetry. A second side 155 of the elongate strip (opposite the first side 154) can have a thickness that is greater than the thickness of the first side 154 so that each header defines a stop surface 158 that extends at least partially in a thickness dimension that is perpendicular to each of the longitudinal axis 151 and the transverse axis 153. The stop surface 158 can be positioned midway between the first and second sides 154,155 relative to the transverse axis 153. In this way, the respective stop surfaces 158 can align the holes (and respective yarns therein) of the two headers for coupling yarns (e.g., burn in, as further described herein).

A retainer 160 can extend across the removable header 118 to retain the yarns in their respective positions relative to each other. For example, in some optional aspects the retainer 160 can comprise one of a hook fastener or a loop fastener (e.g., VELCRO fastener) that is configured to engage the other of the hook fastener or the loop fastener of the header 118. In further options, the retainer can be a member (e.g., a metal or polymer strip) that can extend across the header and clamp against the header with the yarns therebetween so that the yarns are under compression between the header 118 and the retainer 160. In still further aspects, the retainer 160 can comprise adhesive tape that extends across the removable header 118. In further aspects, the retainer 160 can retain the yarns directly to the adapter plate 112.

Figure 13:
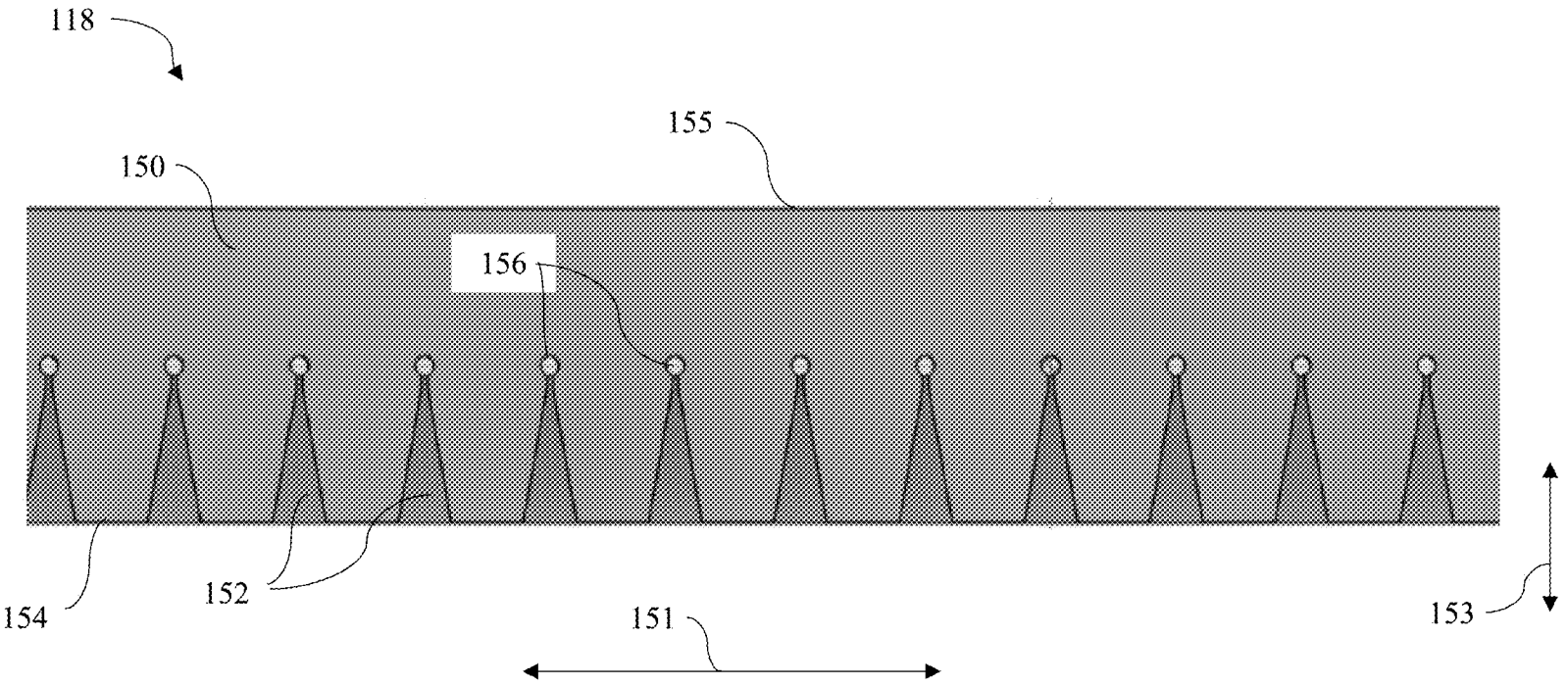
FIG. 13 is a top view of a removable header for use with the yarn transport modules as disclosed herein.
Figure 14:
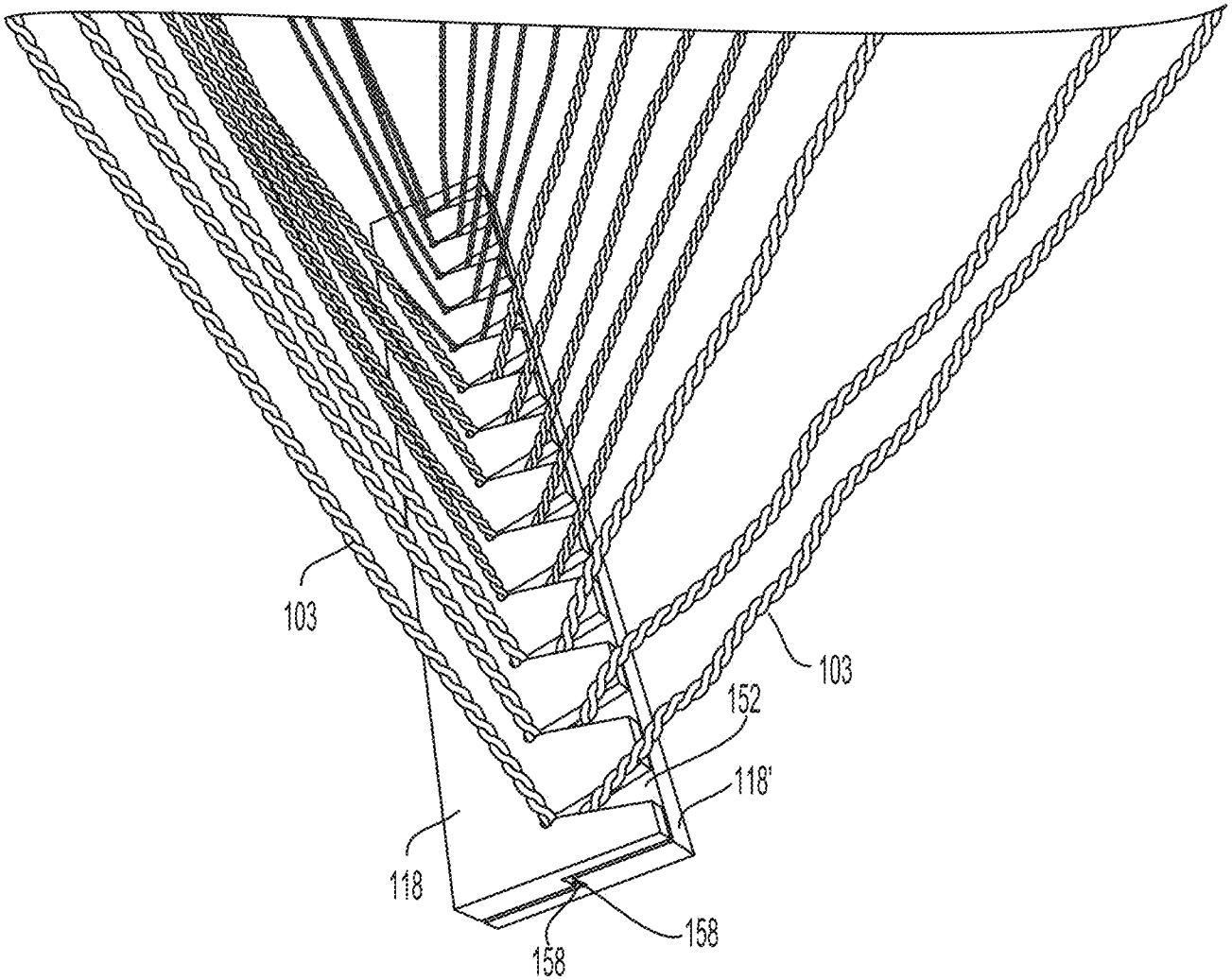
FIG. 14 is a perspective view of a pair of headers that are adjoined for coupling yarn ends together.

Although an exemplary construction of a removable header 118 and an associated retainer 160 are disclosed with reference to FIGS. 13-15, various other constructions can be used. It is contemplated that the removable header 118 can be a structure (or a portion thereof) that maintains the yarns in a particular order to inhibit crossing, twisting, or tangling of the yarns. In further exemplary aspects, the removable header can maintain the yarns in a spaced relationship along an axis to facilitate joining of the yarns with yarns of the yarn processing machine (e.g., tufting machine or winding machine). For example, in one aspect, the removable header 118 and the retainer 160 can be a strip of hook material and a strip of loop material, respectively. The strips of hook material and loop material can be coupled with the yarns retained therebetween to maintain the order (and, optionally, spacing) of the yarns. In yet further aspects, the removable header 116 and retainer 160 can comprise strips respective of tape. One or both of the strips of tape can comprise adhesive thereon. Thus, the strips of tape can be adjoined (via the adhesive) with the yarns therebetween to maintain the order (and, optionally, spacing) of the yarns. In yet further aspects, the header 118 and the retainer 160 can be respective rigid strips of material that are compressed (e.g., clamped) together with the yarns positioned therebetween to maintain the order (and, optionally, spacing) of the yarns.

Yarn Transport Module Comprising Warp Beam

Figure 9:
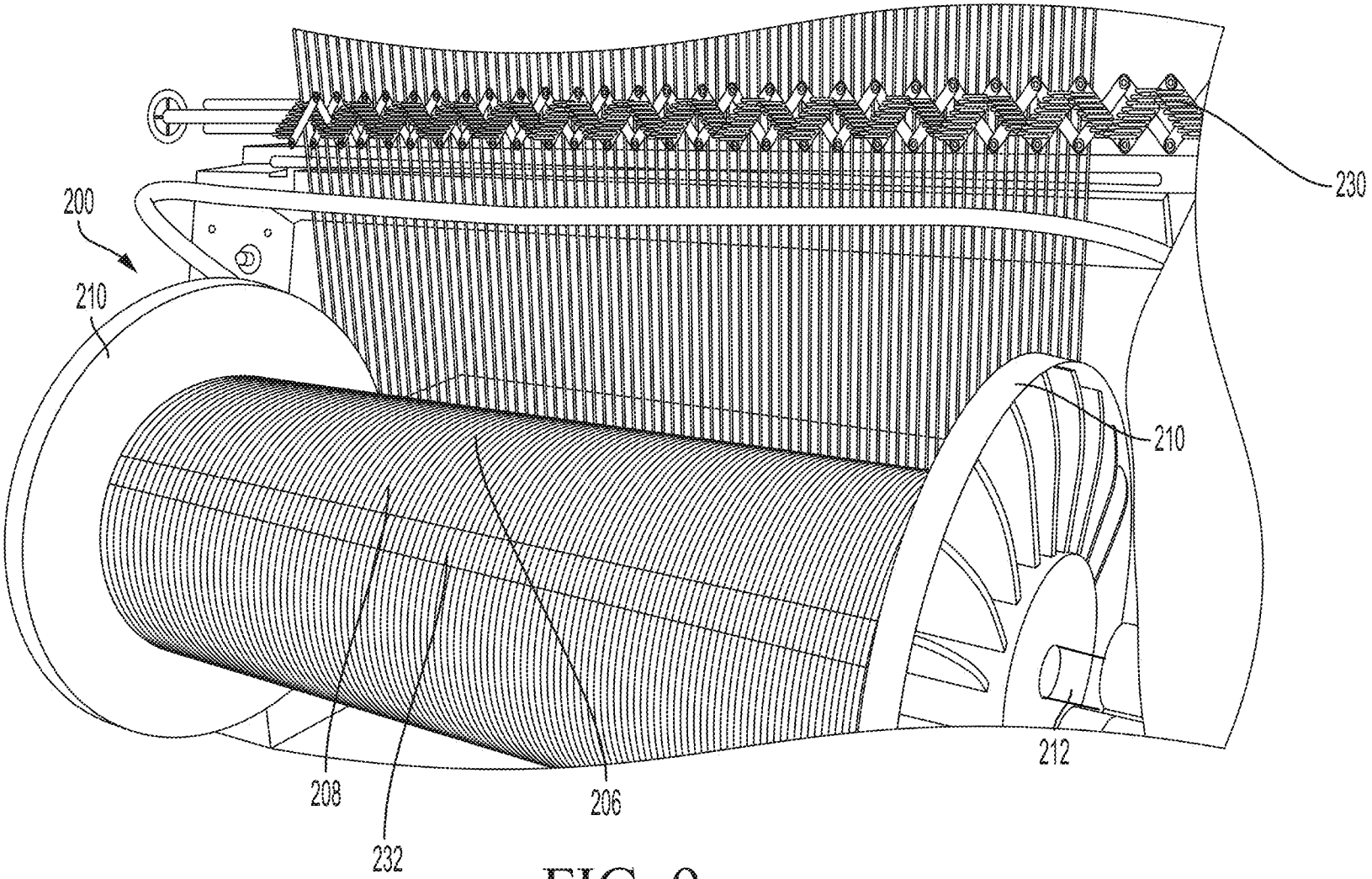
FIG. 9 is a perspective view of a warp beam of a yarn transport module receiving yarn and having a header extending there across.
Figure 12:
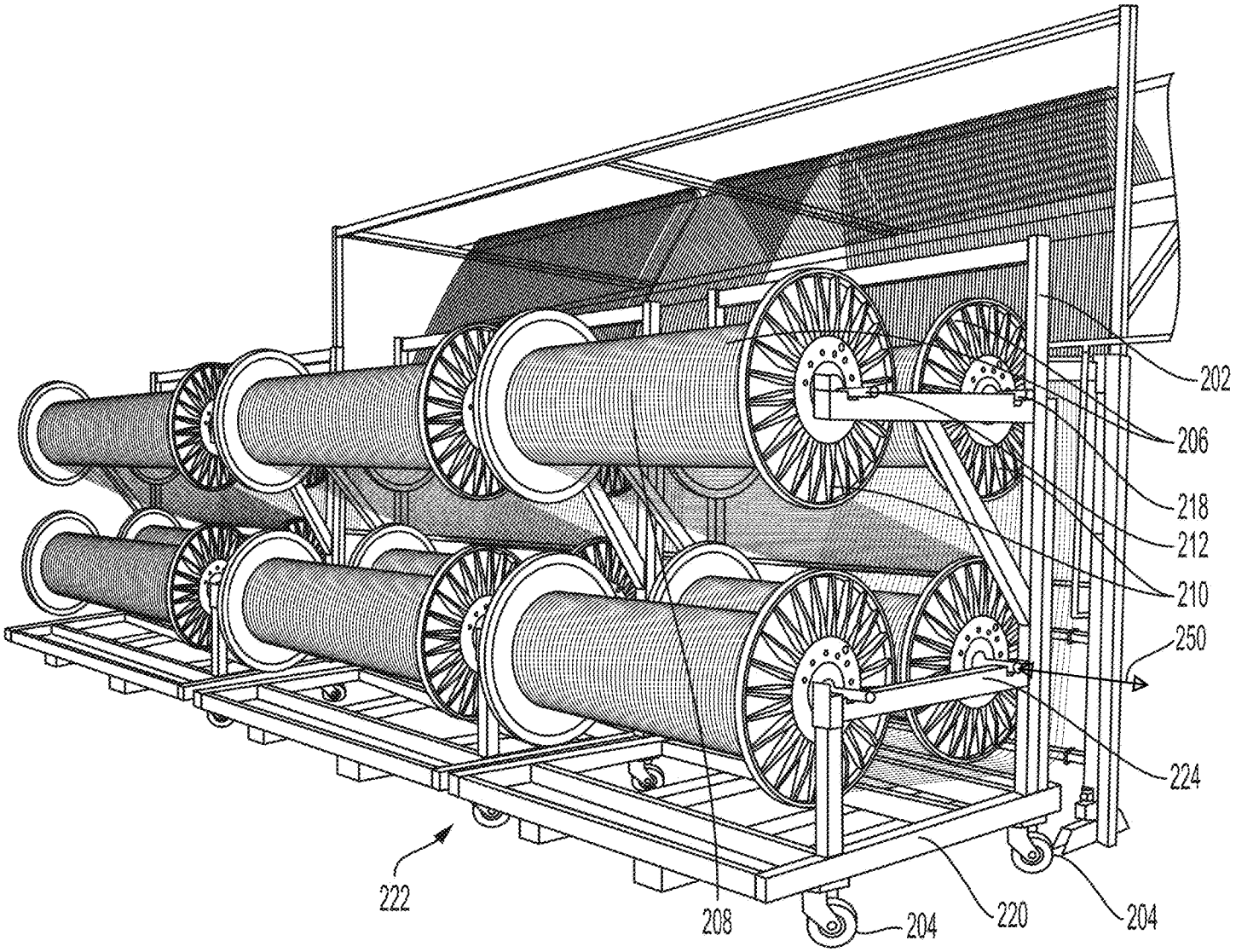
FIG. 12 is a perspective view of a yarn transport module comprising a plurality of warp beams.

Referring to FIGS. 9 and 12, in some aspects, the yarn transport modules 104 can comprise a frame 202 that is movably supported on wheels 204. One or a plurality of warp beams 206 (e.g., four warp beams, as shown in FIG. 12) can be removably positioned on the frame. Each warp beam 206 can comprise a body 208 (optionally, a cylindrical body) about which yarn can be wound. Opposing end plates 210 can retain the yarn therebetween. A rod 212 (or other support element) can extend through the body 208 and can extend outwardly of each respective end plate 210. The warp beam 206 can be supported by the ends of the rod 212 so that the warp beam 206 can rotate about the rod. In exemplary aspects, the warp beam 206 can comprise a bearing that receives the rod 212 and facilitates rotation thereabout. Optionally, each warp beam 206 can be motor controlled to provide consistent tension as the diameter of yarn wound around the warp beam increases during production and winding.

In some aspects, for each warp beam 206 that the frame 202 supports, the frame can define a receptacle 218 (e.g., a slot or a notch) on each side of the frame that can receive a respective end of the rod 212. For example, the frame 202 can have a first side 220 and a second side 222 connected at a base. Each side can comprise two vertically spaced rows of beams 224. Each beam 224 can define a pair of receptacles that are spaced relative to the beams' longitudinal axes so that opposing beams 224 on the first and second sides 220, 222 can cooperatively support two rollers. Thus, in some exemplary aspects, the frame 202 can support four warp beams 206. However, other beam and frame configurations can be used to support more or fewer rollers and beams. In some optional aspects, the receptacles 218 can have surfaces (e.g., hemicylindrical surfaces) having substantially the same diameter as the rod 212.

A forklift, crane, or other lifting device can lift the warp beams 206 from their respective receptacles and position the warp beam 106 on a warp beam machine 200 of the heat set 102. The warp beam machine 200 can be configured to support the warp beam 206 in position for receiving yarn and rotate the warp beam around the rod 212 to wind the yarns. The warp beam machine 200 can further define a yarn spacing assembly 230 that directs yarns in a spaced arrangement to the warp beam 206. Optionally, as a non-limiting example, each warp beam can hold 22,000 feet of yarn (2 ply, 1000 denier per ply) which can, in some optional aspects, form 2100 feet of finished carpet with a ½" pile height. Once the warp beam 206 has a desired quantity of yarn wound around the beam, the lifting device can position the warp beam on the frame (with the ends of the rod 212 disposed within respective receptacles 218).

When positioned on the frame 202, the warp beams 206 can be configured to rotate so that as the ends of the yarns are pulled (e.g., as a tufting device pulls on the yarn), the warp beam can rotate to feed the yarn from the warp beam (e.g., to the tufting device).

It is contemplated that the yarn transport module comprising one or more warp beams 206 can implement any of the removable headers as disclosed herein (e.g., as shown in FIGS. 13-15). In further aspects, as shown in FIG. 9, a strip of hook fastener 232 can be positioned in engagement with the yarns so that the fastening elements of the hook fastener extend outwardly from the yarn. (Optionally, the hook fastener can be pressed against the yarns before the yarns are wound around the warp beam, and the warp beam can then be wound (e.g., one revolution) to position the hook fastener on the beam with the yarns extending thereacross.) A strip of loop fastener can then be coupled to the hook fastener to maintain the yarns in their respective positions. In this way, the hook and loop fastener can serve as the removable header 118 and retainer 160, respectively. In further aspects, the hook and loop strips can have reversed positions from those described above. In still further aspects, opposing adhesive backed polymer strips (e.g., tape) can serve as the removable header 118 and retainer 160. In yet further aspects, an arm can be clamped down against the yarns wound around the beam to retain the yarn ends.

Processing Yarn from the Yarn Transport Modules

Referring to FIGS. 10 and 13-15, once a yarn transport module 104 is sufficiently filled (or once the beams 206 have sufficient yarn wound therearound), the retainer 160 can be placed across the removable header 118 so that the yarns are fixed in respective positions relative to each other along the longitudinal axis of the removable header. The yarns can then be severed so that each yarn has a first end 240 (FIG. 6) within a respective container and an opposing loose end 242 (FIG. 16), and the retainer 160 can be secured to the removable header between the first ends and the loose ends of the yarns.

The yarn transport module 104 can then be moved for subsequent yarn processing. For example, in some aspects, the yarn transport module 104 can provide yarn to a tufting machine 250. It is contemplated that a plurality of yarn transport modules 104 can be provided at the tufting machine 250 to simultaneously feed yarn into the tufting machine.

The yarn transport module 104 can be moved into position proximate to the tufting machine 250. For example, it is contemplated that, optionally, twelve warp beams 206 (e.g., three frames 202 having four warp beams 206 thereon) can be positioned at the tufting machine 250. In further aspects, 24 yarn transport modules 104, each yarn transport module comprising 48 containers 110, can be positioned at the tufting machine 250. In this way, a large number of yarn ends (e.g., approximately 1000 yarn ends) can simultaneously be provided to a tufting machine. FIG. 11 illustrates a splicing station at which yarn ends from the yarn transport modules can be spliced with yarn ends from the tufting machine 250, and from which the yarns from the yarn transport modules can be fed to the tufting machine 250.

Referring to FIGS. 10 and 13-15, respective yarns of each of the yarn transport modules 104 can be aligned with respective beginning ends 244 of the yarns of the tufting machine 250. In some aspects, the beginning ends 244 of the yarns of the tufting machine can be retained in a header 118' of the tufting machine. The header 118 of the yarn transport module 104 can be configured to engage the header 118' of the tufting machine so that when their respective longitudinal ends are aligned and their respective stop surfaces 158 are biased against each other, the holes through which the yarns extend are likewise aligned. In some optional aspects, the headers 118, 118' can define respective slots 162 that can receive a respective compression plate 226 from the respective second side 155. The respective compression plate 226 can be inserted into each slot 162 until the yarns come into contact with each other. The compression plates can have a thickness that allows the plates to be receivable into the slots 162. Optionally, in some aspects, the compression plates 226 can be coupled together and movable relative to each other along an axis between a first position, in which the compression plates are sufficiently separated to receive the adjacently positioned pair of headers 118, 118', and a second position, in which the compression plates are biasing the yarns together. For example, in some aspects, a first compression plate can be fixedly coupled to a pair of rails that are parallel to the axis of motion of the pair of compression plates, and the other compression plate can slide relative to the first compression plate along the pair of rails. Optionally, an actuator (e.g., a spring-biased actuator, piston, or other suitable actuator) can bias the compression plates 226 toward each other. In this way, an operator can squeeze the headers 118, 118' together, thereby pressing the yarns against each other, and the actuator can apply additional compression to the yarns. One or both of the compression plates 226 can comprise a heating element that is configured to fuse the yarns together (e.g., burn in). When such a heating element(s) is/are provided, it is contemplated that the compression plate can be in communication with a user input device (e.g., a button, a switch, a knob, or the like) that is configured to permit selective activation or inactivation of the heating element. Additionally, or alternatively, it is contemplated that a controller (e.g., a controller as disclosed herein) can be configured to control operation of the heating element.

Once the yarns are fused, the tufting machine 250 can be run according to normal operation. The headers 118, 118' can be removed from engagement with the yarns. For example, in some aspects, the removable header 118 can be positioned on the carrying structure defined by the frame of the yarn transport module. Referring to FIG. 11, the yarns can travel from the yarn transport module 104, to a frame 260 of the tufting machine, through tubes 262, and ultimately to tufting needles. It is contemplated that the metering devices 124 of the yarn delivery system 106 can be used to determine the amount of yarn drawn from the yarn transport modules before the yarn is exhausted. Yarn length data (e.g., the length of yarn in each container) can be stored in a database. The tufting machine can have a yarn consumption rate. Thus, the yarn length data and yarn consumption rate can determine the amount of time that the tufting machine can draw from the yarn transport modules.

Yarn Transport Module for Feeding a Twisting Machine

Figure 17:
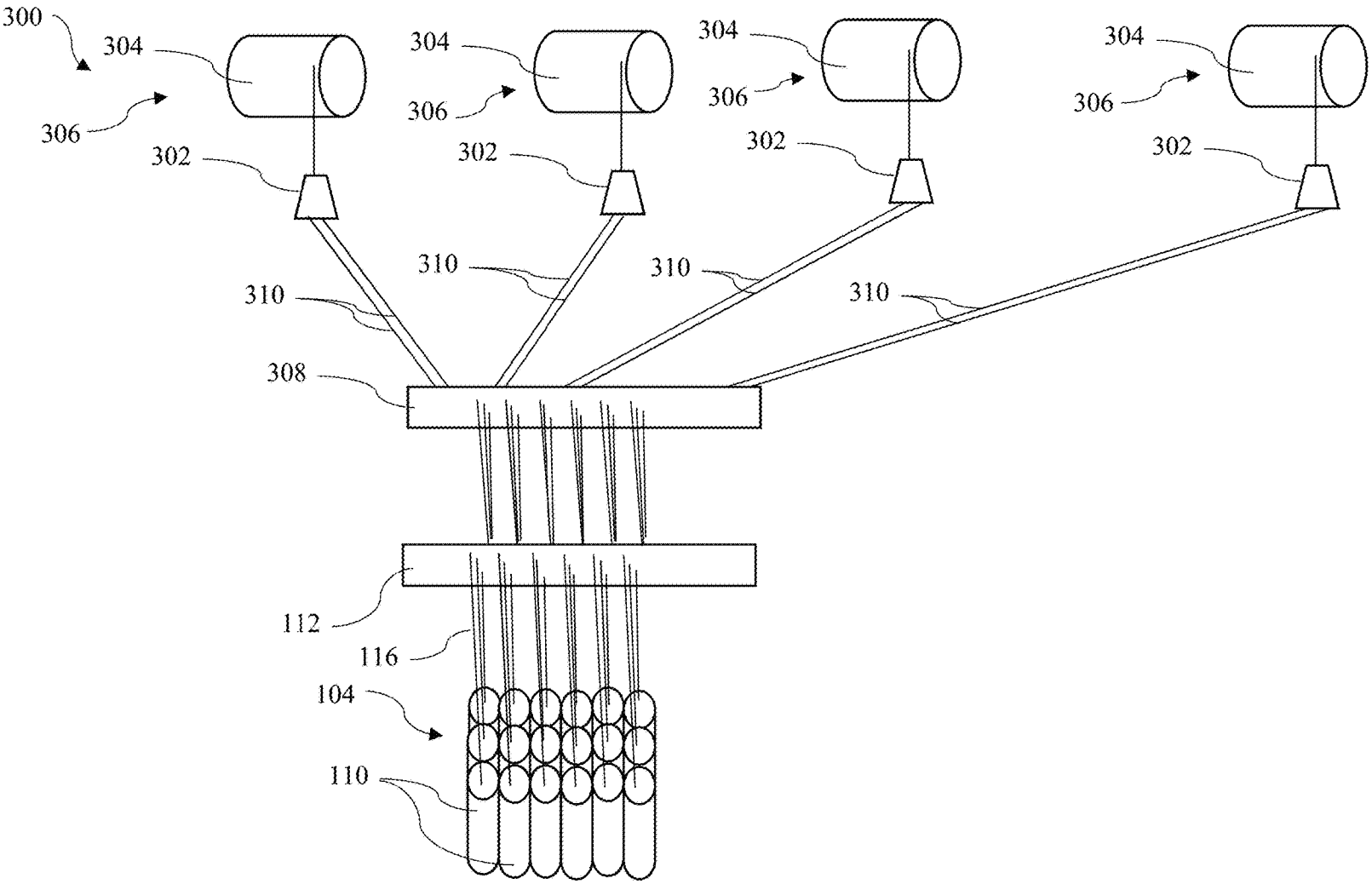
FIG. 17 is a schematic diagram of a system for providing yarn to a twisting machine comprising a plurality of positions.

It is contemplated the yarn transport modules 104 are not limited to transporting yarn to a tufting machine and can instead provide yarn to other yarn processing machines. As used herein, the term "yarn processing machine" can refer to any machine or system that is configured to physically manipulate that position, shape, orientation, or physical properties of yarn. For example, referring to FIGS. 16-17, in some aspects, yarn from an extruder can be provided to a twisting machine 300 via a yarn transport module 104 as described herein. For example, the yarn transport module 104 can receive yarn from the extruders in the same manner as yarn provided from a heat set tunnel. The yarn transport module 104 can then be transported to a twisting machine 300. Pairs of yarn 103 (FIG. 1) (e.g., from pairs of containers 110 of the plurality of yarn containers) from the yarn transport module 104 can be fed to each position 306 of the twisting machine 300. In some aspects, each twisting machine 300 can comprise a plurality of positions (e.g., optionally, one hundred positions or more). The each position can comprise a twister 302 and a winder 304 that can wind twisted pairs of yarn therearound. In some aspects, a frame 308 can support a plurality of tubes 310 that guide respective pairs of yarns to each twisting machine.

In some aspects, a yarn transport module 104 can comprise a plurality of containers (e.g., 24 or 48 containers), and yarns from pairs of containers can feed a twisting machine 300. Optionally, a yarn transport module 104 can feed a plurality of positions 306 of a twisting machine 300 simultaneously.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system comprising: a plurality of containers that are coupled together as a movable unit; and a plurality of container-feeding assemblies that are configured to simultaneously deliver respective yarns into respective containers of the plurality of containers.

Aspect 2: The system of aspect 1, further comprising: a header that is configured to receive yarn ends of the yarns in the plurality of containers, the header having a longitudinal axis; and a retainer that is configured to extend across the header along the longitudinal axis to secure the respective yarns in respective positions relative to each other along the longitudinal axis.

Aspect 3: The system of aspect 1 or aspect 2, wherein the plurality of container-feeding assemblies comprises a plurality of aspirators.

Aspect 4: The system of aspect 3, wherein the movable unit further comprises an adapter plate defining a plurality of openings and a respective guide tube extending between each opening of the adapter plate and a respective container, wherein each aspirator of the plurality of aspirators is positioned at a respective opening of the adapter plate.

Aspect 5: The system of any one of the preceding aspects, wherein each container-feeding assembly of the plurality of container-feeding assemblies comprises: opposing rollers that bias against opposing sides of the respective yarn; and at least one motor that is coupled to at least one of the opposing rollers and is configured to cause rotation of the at least one of the opposing rollers.

Aspect 6: The system of any one of the preceding aspects, wherein the plurality of containers are see-through.

Aspect 7: The system of any one of the preceding aspects, wherein each container is tubular or substantially tubular.

Aspect 8: The system of any one of the preceding aspects, wherein each container comprises a flexible sidewall.

Aspect 9: The system of any one of the preceding aspects, further comprising at least one yarn metering device that is configured to measure a quantity of yarn delivered into a container of the plurality of containers.

Aspect 10: The system of aspect 9, wherein the at least one yarn metering device comprises a plurality of yarn metering devices, wherein each yarn metering device of the plurality of yarn metering devices is configured to measure the quantity of yarn delivered into a respective container of the plurality of containers.

Aspect 11: The system of aspect 9 or aspect 10, wherein the at least one metering device comprises a roller.

Aspect 12: The system of any one of the preceding aspects, further comprising a pair of opposing drive rollers that are configured to maintain a select tension on yarn leaving a heat set apparatus.

Aspect 13: The system of any one of the preceding aspects, further comprising a plurality of plungers, wherein each plunger of the plurality of plungers is configured to reciprocally move inwardly into a respective container to compress yarn within the container.

Aspect 14: The system of aspect 13, wherein each plunger defines a longitudinal bore therethrough through which a respective yarn can extend.

Aspect 15: The system of aspect 13 or aspect 14, wherein each plunger is configured to intermittently move inwardly into and outwardly from the respective container.

Aspect 16: The system of aspect 13 or aspect 14, wherein each plunger is configured to continuously move inwardly into and outwardly from the respective container.

Aspect 17: The system of any one of the preceding aspects, further comprising a heat set apparatus that is configured to deliver the yarns to respective container feed assemblies.

Aspect 18: A method comprising: delivering a first plurality of yarns into respective containers of the system as in any one of aspects 2-17, wherein the header is a first header; securing the retainer to the first header to fix the respective yarns of the first plurality of yarns in respective positions relative to each other along the longitudinal axis of the first header; severing the first plurality of yarns so that each yarn of the first plurality of yarns has a first end within a respective container and an opposing loose end, wherein the retainer is secured to the first header between the first ends and the loose ends of the first plurality of yarns; positioning the movable unit proximate to a second header of a yarn processing machine, the yarn processing machine having a second plurality of yarns thereon, each yarn of the second plurality of yarns on the yarn processing machine having a respective beginning end; aligning the first header with the second header so that the loose ends of the first plurality of yarns are aligned with respective beginning ends of the second plurality of yarns on the yarn processing machine; and coupling respective loose ends of the first plurality of yarns in the containers to respective beginning ends of the second plurality of yarns of the yarn processing machine.

Aspect 19: The method of aspect 18, wherein the yarn processing machine is a tufting machine.

Aspect 20: The method of aspect 18, wherein the yarn processing machine is a twisting machine.

Aspect 21: A system comprising: a warp beam having a central axis about which the warp beam is configured to rotate; a warp beam machine that is configured to wind a plurality of yarns received from one or more heatset apparatuses around the warp beam; a frame that is configured to support at least one warp beam thereon; and a plurality of wheels that are coupled to the frame and configured to movably support the frame.

Aspect 22: The system of aspect 21, wherein the frame is configured to receive a plurality of warp beams thereon.

Aspect 23: The system of aspect 21 or aspect 22, further comprising a header that is configured to receive yarn ends of the yarns in the plurality of containers, the header having a longitudinal axis; and a retainer that is configured to extend across the header along the longitudinal axis to secure the respective yarns in respective positions relative to each other along the longitudinal axis.

Aspect 24: A method comprising: winding a first plurality of yarns onto the warp beam of the system of any one of aspects 20-23, wherein the header is a first header; securing the retainer to the first header to fix the respective yarns of the first plurality of yarns in respective positions relative to each other along the longitudinal axis of the header; severing the first plurality of yarns so that each yarn of the first plurality of yarns has a loose end proximate the first header, wherein the first header and retainer are fixed together between the warp beam and the loose ends of the first plurality of yarns; positioning the warp beam on the frame; positioning the warp beam proximate to a second header of a yarn processing machine, the yarn processing machine having a second plurality of yarns thereon, each yarn of the second plurality of yarns on the yarn processing machine having a respective beginning end; aligning the first header with the second header so that the loose ends of the first plurality of yarns are aligned with respective beginning ends of the second plurality of yarns on the yarn processing machine; and coupling respective loose ends of the first plurality of yarns in the containers to respective beginning ends of the second plurality of yarns of the yarn processing machine.

Aspect 25: The method of aspect 24, wherein the yarn processing machine is a tufting machine.

Aspect 26: The method of aspect 24, wherein the yarn processing machine is a twisting machine.

Although several embodiments of the invention have been disclosed in the foregoing specification and the following appendices, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A system comprising:

a plurality of containers that are coupled together as a movable unit;

a plurality of container-feeding assemblies that are configured to simultaneously deliver respective yarns into respective containers of the plurality of containers;

a header that is configured to receive yarn ends of the yarns in the plurality of containers; and a retainer that is configured to extend across the header to secure the respective yarns in respective positions relative to each other.

2. The system of claim 1, wherein the plurality of container-feeding assemblies comprises a plurality of aspirators.

3. The system of claim 2, wherein the movable unit further comprises an adapter plate defining a plurality of openings and a respective guide tube extending between each opening of the adapter plate and a respective container, wherein each aspirator of the plurality of aspirators is positioned at a respective opening of the adapter plate.

4. The system of claim 1, wherein each container-feeding assembly of the plurality of container-feeding assemblies comprises:

opposing rollers that bias against opposing sides of the respective yarn; and at least one motor that is coupled to at least one of the opposing rollers and is configured to cause rotation of the at least one of the opposing rollers.

5. The system of claim 1, wherein the plurality of containers are see-through.

6. The system of claim 1, wherein each container is tubular or substantially tubular.

7. The system of claim 1, wherein each container comprises a flexible sidewall.

8. The system of claim 1, further comprising at least one yarn metering device that is configured to measure a quantity of yarn delivered into a container of the plurality of containers.

9. The system of claim 8, wherein the at least one yarn metering device comprises a plurality of yarn metering devices, wherein each yarn metering device of the plurality of yarn metering devices is configured to measure the quantity of yarn delivered into a respective container of the plurality of containers.

10. The system of claim 8, wherein the at least one metering device comprises a roller.

11. The system of claim 1, further comprising a pair of opposing drive rollers that are configured to maintain a select tension on yarn leaving a heat set apparatus.

12. The system of claim 1, further comprising a plurality of plungers, wherein each plunger of the plurality of plungers is configured to reciprocally move inwardly into a respective container to compress yarn within the container.

13. The system of claim 12, wherein each plunger defines a longitudinal bore therethrough through which a respective yarn can extend.

14. The system of claim 12, wherein each plunger is configured to intermittently move inwardly into and outwardly from the respective container.

15. The system of claim 12, wherein each plunger is configured to continuously move inwardly into and outwardly from the respective container.

16. The system of claim 1, further comprising a heat set apparatus that is configured to deliver the yarns to respective container feed assemblies.

17. A method comprising:

delivering a first plurality of yarns into respective containers with a plurality of container-feeding assemblies that are configured to simultaneously deliver respective yarns into respective containers of the plurality of containers, wherein the a plurality of containers are coupled together as a movable unit; and securing a retainer to a first header to fix the respective yarns of the first plurality of yarns in respective positions relative to each other along the longitudinal axis of the first header.

18. The method of claim 17, further comprising:

severing the first plurality of yarns so that each yarn of the first plurality of yarns has a first end within a respective container and an opposing loose end, wherein the retainer is secured to the first header between the first ends and the loose ends of the first plurality of yarns;

positioning the movable unit proximate to a second header of a yarn processing machine, the yarn processing machine having a second plurality of yarns thereon, each yarn of the second plurality of yarns on the yarn processing machine having a respective beginning end;

aligning the first header with the second header so that the loose ends of the first plurality of yarns are aligned with respective beginning ends of the second plurality of yarns on the yarn processing machine; and coupling respective loose ends of the first plurality of yarns in the containers to respective beginning ends of the second plurality of yarns of the yarn processing machine.

19. The method of claim 18, wherein the yarn processing machine is one of a tufting machine or a twisting machine.

* * * * *